United States Patent [19]

Jabsen

[11] 4,447,942

[45] May 15, 1984

[54] HELICAL STEAM GENERATOR TUBE SUPPORT

[75] Inventor: Felix S. Jabsen, Lynchburg, Va.

[73] Assignee: The Babcock & Wilcox Company, New Orleans, La.

[21] Appl. No.: 368,790

[22] Filed: Apr. 15, 1982

Related U.S. Application Data

[62] Division of Ser. No. 192,775, Oct. 1, 1980, Pat. No. 4,337,827.

[51] Int. Cl.[3] ..... B23P 15/26; F28F 9/00

[52] U.S. Cl. ..... 29/157.4; 165/172

[58] Field of Search ..... 29/157.4; 165/162, 172; 248/68 R; 122/510

[56] References Cited

U.S. PATENT DOCUMENTS

| | | | |
|---|---|---|---|
| 3,677,339 | 7/1972 | Perrin et al. | 165/162 |
| 3,998,268 | 12/1976 | Sagan | 165/172 |
| 4,010,796 | 3/1977 | Scholtus | 165/162 |
| 4,231,421 | 11/1980 | Eaton et al. | 165/172 |

*Primary Examiner*—Howard N. Goldberg
*Assistant Examiner*—V. K. Rising
*Attorney, Agent, or Firm*—Robert J. Edwards; J. Henry Muetterties; James C. Simmons

[57] ABSTRACT

A tube support structure for a helically coiled fluid heat exchanger including a plurality of support strips interconnected by a plurality of support members. Two tubes are nested between support members against a support strip, a spring plate is placed over the tubes and a second strip is pressed on the assembly to the desired spring pressure and affixed.

2 Claims, 3 Drawing Figures

HELICAL STEAM GENERATOR TUBE SUPPORT

This application is a division, of application Ser. No. 192,775, filed Oct. 1, 1980, new U.S. Pat. No. 4,337,727.

BACKGROUND

The invention relates to helically coiled tube heat exchangers and, more particularly, to an improved technique for stabilizing the tubes in an array by spring loading the tubes within a channel structure, and the like.

There is a need for heat exchangers in which the tubing is coiled in an helical manner. Naturally, the environment within these heat exchangers, i.e., boiling fluid and high velocity flow conditions, frequently requires that the coiled tubes should be securely anchored to prevent undesirable vibration attendant damage. Because these heat exchangers often are operated at high temperatures, there also is a somewhat conflicting need for a tube mounting structure that will provide the tube with sufficient latitude for thermal expansion and contraction.

Through the years, a number of proposals have been advanced for resolving this important engineering problem. The patents identified in the following are a representative sample of a number of these proposals:

U.S. Pat. No. 3,989,105 shows layers of undulating tubes fitted between concentric hoops and tube braces that are wedged between the adjacent tubes in each layer.

U.S. Pat. No. 3,782,455 shows a series of circumferential bars in a concentric arrangement for grasping tubes which are received in indentations that are formed in the bars.

U.S. Pat. No. 3,677,339 describes a structure in which the tubes are wedged between aligned spacer bars. Each of these spacer bars has projecting lugs that straddle the adjacent tube and engage a lock strip for securing the coil to the associated spacer bar.

U.S. Pat. No. 3,554,168 discloses tube support members that are in frictional engagement in order to provide a sliding contact that will permit thermal expansion.

U.S. Pat. No. 3,545,537 relates to thin plates that support recessed bars which engage and sustain heat exchanger tubes.

U.S. Pat. No. 3,545,534 shows apertured and slotted support members to which are fastened attachments that have tube-receiving surfaces.

U.S. Pat. No. 3,509,939 discloses a conical hollow displacement member from which radial arms protrude. The radial arms, in turn, sustain carrying rods that support the tubes in question.

U.S. Pat. No. 3,286,767 describes a technique for clamping the tubes in a support member.

U.S. Pat. No. 3,026,858 is directed to water cooled tube supports in which the tubes lay upon rollers to permit thermal expansion and contraction.

U.S. Pat. No. 2,884,911 shows U-shaped members that sustain plate members which have recesses for receiving the heat exchanger tubes.

U.S. Pat. No. 2,402,209 shows finned tubes that are clamped between corrugated strips.

U.S. Pat. No. 2,175,555 describes still another support structure in which the intermediate supports have sections with prongs for embracing the individual tubes.

U.S. Pat. No. 1,973,129 discloses rigid blocks that have sockets which are individual to the tube runs and in which the tubes are received.

All of these foregoing patents attempt to solve one problem at the expense of a solution to the other problem. Thus, the tubes shown in a number of these patents are rigidly mounted in the support structure to overcome possible vibration difficulties. As mentioned above, however, a rigid mounting of this nature tends to promote stresses that are attributable to thermal expansion and contraction.

On the other hand, to simply lay the tubing on rollers or to place it in a loose support arrangement may provide a degree of compensation for thermal expansion and contraction. This loose assembly is nevertheless likely to invite vibration and attendant damage.

Consequently, there is a definite need to reconcile these conflicting requirements with a structure that is sturdy, relatively inexpensive and easy to install and maintain.

SUMMARY OF THE INVENTION

These and other problems that have characterized the prior art are alleviated to a great extent through the practice of the present invention. Illustratively, a notched channel is provided for supporting a row of tubes. A spring plate is placed over the tubes to hold the tubes in the row in their proper relative positions. Another channel is placed in contact with the spring plate and secured in position.

In this manner, not only are the tubes in each row mounted in a manner that overcomes vibration forces, and the like, but the spring plate also decreases the stresses on the tubes during thermal expansion and contraction.

In addition to the very useful novelty of this improved tube support, there is a further valuable and quite surprising advantage in the structure under consideration. More specifically, through the application of a predetermined force to the channel that is placed in contact with the spring plate, the spring forces that actually are applied to the tubes can be determined with a degree of accuracy and uniformity that heretofore was simply unattainable with prior art techniques.

Thus, there is provided a means for mounting tubes and, more particularly, helically and other coiled tubes in a manner that suppresses vibration but nevertheless permits thermal expansion and contraction without generating potentially destructive stresses.

DESCRIPTION OF THE PREFERRED EMBODIMENT

Figure 1:
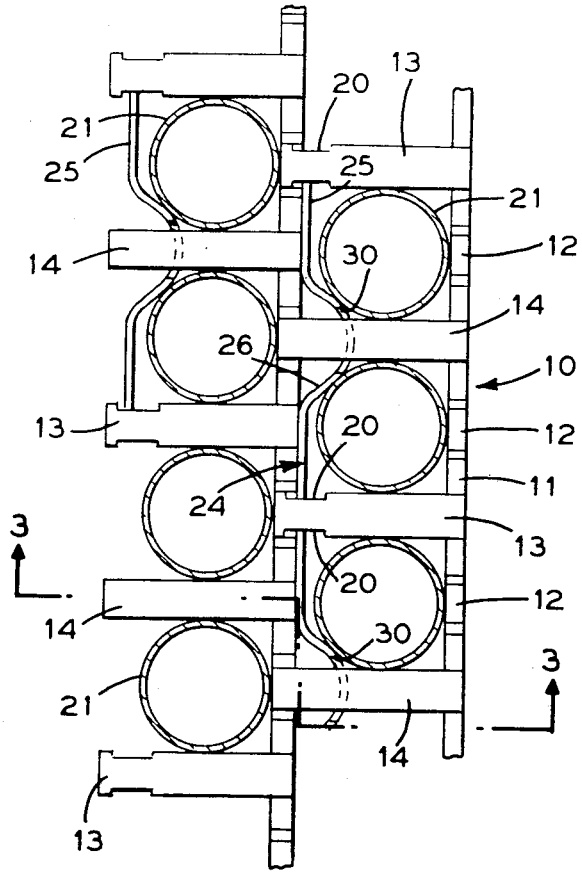
FIG. 1 is a partial front elevation of a portion of a helical heat exchange tube bank that embodies important features of the invention.

For a more complete appreciation of the invention, attention is invited to FIG. 1 wherein a preferred embodiment of the invention is shown.

FIG. 1 is a partial elevation view within a helically coil steam generator cut across a bank of helically coiled tubes 21, coiling upward at an acute angle with the horizontal. As illustrated, a vertically extending channel structure 10 has a generally flat vertically extending support strip 11 which has notches 12 formed at regularly spaced intervals in each strip edge.

Support members 13 and 14 extend perpendicular to the plane of the flat strips 11 and generally in the radial direction of the helical coil steam generator and in the preferred embodiment are formed in each edge of strips 11 at regularly spaced intervals. Support members 13 and 14 moreover, are interleaved between the notches 12.

Successive adjacent members 13 and 14 have slightly different perpendicular extremeties. For example, member 14 has a generally rectangular shape. Member 13, however, has an end that is provided with recesses 20 which will be explained subsequently in more complete detail.

Tubes 21 are nested between successive, alternate sets of spaced support members 13 and 14.

Support members 13 and 14 extend to adjacent strip 11 and the ends of members 13 and 14 mate with and are welded to notches 12 of adjacent strips 11. This structure is repeated for as many rows of tubes as desired both vertically and radially with respect to the axis (not shown) of the helically coiled steam generator.

In accordance with an important feature of the invention, a number of spring plates 24 are fitted between the support members extending from the edges of strips 11. Spring plate 24 has generally flat portions 25 which are parallel to strips 11 and are interrupted with corrugation 26 that extend athwart or transverse relative to the length of the spring plate 24. Typically, corrugation 26 is oriented toward the flat strip 11 and is positioned such that the corrugations are tangent to and bear against respective subadjacent tubes 21. Thus, corrugation 26 presses against two adjacent tubes 21 retaining them in the recesses formed by the adjacent sequential support members 13 and 14.

Figure 2:
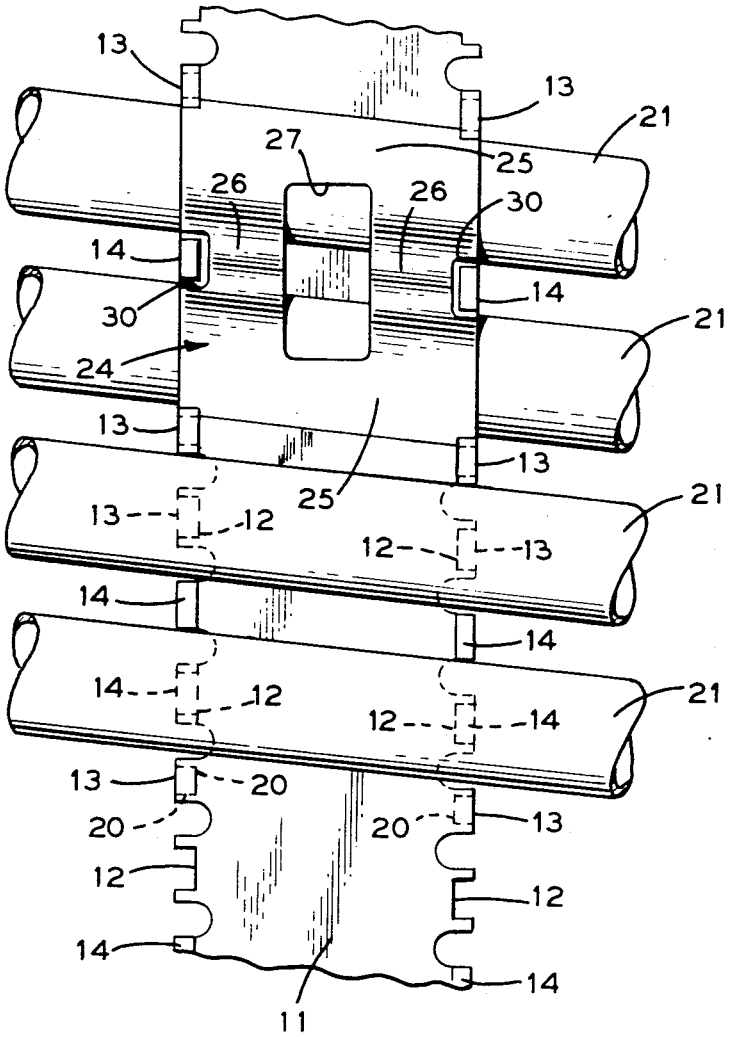
FIG. 2 is a side elevation view of the portion of the tube bank that is shown in FIG. 1.

As shown in FIGS. 1 and 2 spring plate 24 has notches 30 formed in the transverse extremities of corrugation 26. Notches 30 are somewhat wider than the widths of the respective support members 14 in order to accomodate support members 14. The edges of spring plate 24 engage recesses 20 of support members 13.

Turn now to FIG. 2 which is oriented with the vertical. Note the rise to the left of tubes 21 as they turn in a helix. Although only four tubes 21 are shown in FIG. 2, the heat exchanger includes hundreds of helically wound tubes 21. Note in FIG. 2 that members 13 and 14 on the left side of plate 11 are positioned in a slightly upward shifted position from members 13 and 14 at the right side of plate 11 as it appears in FIG. 2, to accommodate the rise to the left of tubes 21. Also note aperture 27 of spring plate 24, which provides a fluid flow path through the structure in a direction parallel to support plates 11 and provides a means for adjusting the stiffness of spring plate 24 to enable both ease of assembly and sufficient spring force. The smaller the aperture 27, the stiffer spring plate 24 will be.

Figure 3:
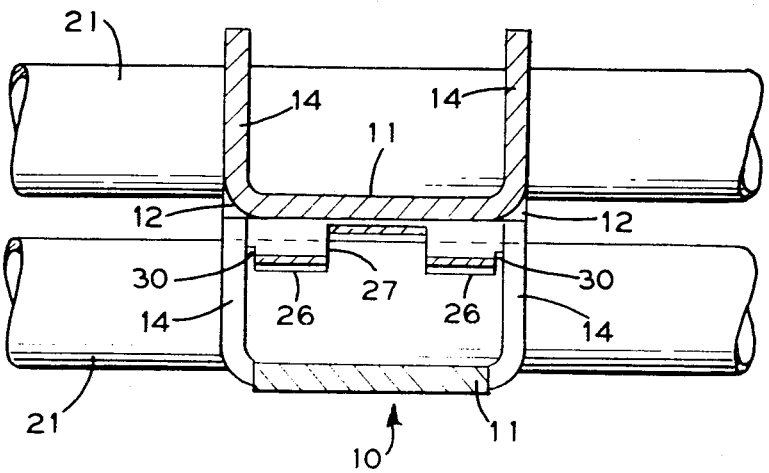
FIG. 3 is a plan view of the portion of the tube bank that is shown in FIG. 1, taken along the line 3—3 and viewed in the direction of the arrows.

Turn now to FIG. 3 where another view of the structure is shown. Note that in the preferred embodiment support members 14 are integral with support plates 11. Thus, a single stamped strip may be formed into channel structure 10.

A helically coiled heat exchanger utilizing the present support structure is assembled as follows. A desired number of vertical channel structures 10 are positioned with support members extending radially outward from the center of the steam generator. An innermost row of tubes is wound and rested in channel structures 10. Upon completion of positioning of two adjacent tubes 21 a corresponding spring plate 24 is positioned thereover by inserting one edge in notches 20, compressing spring plate 24 and snapping the remaining edge into its corresponding notches 20. Spring plate 24 is sized such that it engages notches 20 and is held in place thereby. Upon completion of the winding of the innermost row of tubes, a second channel structure 10 is positioned such that its notches 12 mate with the support members 13 and 14 of the first channel structure 10. The channel structures 10 and then pressed together, compressing springs 24 to a desired and support members 13 and 14 are welded to mating notches 12. Subsequent rows of helically wound tubes are added in the same manner until the steam generator is complete. To secure the outermost winding, a support plate 11 minus support members 13 and 14 may be used.

In the preferred embodiment, as above described, tube 21 elevations are staggered from row to row progressing radially. If it is desired to build a helically coiled heat exchanger having tubes in line rather than staggered tubes as described, this can be accomplished with the present invention by merely eliminating support members 14, and positioning all notches 12 at the prior support members 14 locations on strips 11. Although this specific embodiment is not illustrated, it is encompassed by the scope of the claims.

In the preferred embodiment as above described, support members 13 and 14 are formed in the edge of strip 11 for ease in manufacturing and assembling. However, the invention is not limited thereto and any suitable of affixing support members 13 and 14 to strip 11 may be employed, for example, providing additional notches 12 and welding members 13 and 14 therein.

The above-described description and drawings are only illustrative of a preferred embodiment which achieves the objects, features and advantages of the present invention, and it is not intended that the present invention be limited thereto. Any modifications of the present invention which come within the spirit and scope of the following claims are considered part of the present invention.

What is claimed as new and desired to be secured by Letters Pat. of the U.S. is:

1. A method of assembling a support structure for a heat exchanger having helically coiled tubes comprising the steps of:

a. providing a plurality of longitudinally extending generally flat support plates having support members affixed to the longitudinal edges thereof and extending perpendicular from the plane thereof, the support members being longitudinally spaced to accept and nest the helically coiled tubes there between, the support plates being notched to mate with the support members of an adjacent plate, a plurality of spring plates, alternating successive support members having recesses to accept the edges of said spring plates, said spring plates being sized to engage said recesses of said alternating support members and having notches to accommodate remaining members and having generally flat portions separated by a corrugation, b. positioning a first set of said plurality of support plates vertically extending and radially distributed about the center of the steam generator;

c. helically winding the heat exchanger tubing to nest between support members of said first set of plates;

d. positioning each of said plurality of springs by inserting a first spring edge in a pair of said recesses, snapping an opposing spring edge into an opposing pair of said recesses such that said corrugaton runs parallel to and bears against a pair of said plurality of tubes;

e. positioning a second set of support plates such that the notches thereof mate with the support members of said first set of support plates;

f. compressing said second set of plates to said first set of plates to compress said spring to a desired pressure;

g. affixing the support members of said first set of support plates to the notches of said second set of support plates; and h. repeating steps c through g with a number of successive sets of support plates until the heat exchanger is fully assembled.

2. The method according to claim 1 wherein the support members of said first set of support plates are welded to the notches of said second set of support plates.

* * * * *